US005081720A

United States Patent [19]

Ames et al.

[11] Patent Number: 5,081,720

[45] Date of Patent: Jan. 21, 1992

[54] DUAL FLUSH FLOAT

[76] Inventors: Donald B. Ames; Ahmad Zenali, both of 16949 S. Western Ave., #6, Gardena, Calif. 90247

[21] Appl. No.: 658,064

[22] Filed: Feb. 20, 1991

[51] Int. Cl.[5] ..... E03D 1/33

[52] U.S. Cl. ..... 4/324; 4/415

[58] Field of Search ..... 4/324, 325, 381, 382, 4/384, 392, 393, 394, 415

[56] References Cited

U.S. PATENT DOCUMENTS

| | | | |
|---|---|---|---|
| 4,483,024 | 11/1984 | Troeh | 4/394 X |
| 4,485,501 | 12/1984 | Kloner | 4/415 X |
| 4,651,359 | 3/1987 | Battle | 4/325 X |
| 4,748,699 | 6/1988 | Stevens | 4/381 X |
| 4,941,214 | 7/1990 | Harris | 4/415 X |
| 4,945,581 | 8/1990 | Harris | 4/415 X |
| 5,023,960 | 6/1991 | Ratanagsu | 4/394 X |

*Primary Examiner*—Charles E. Phillips
*Attorney, Agent, or Firm*—Macro-Search Corp.

[57] ABSTRACT

A dual mode flush control apparatus installed in a flush tank provides a choice of either a full flush or a partial flush. A primary float slidably engaged with a vertical float guide is free to move in a vertical path. A catch arm is pivotally attached to the primary float, one portion of which extends away from the primary float and attaches to a secondary float. A further portion of the catch arm extends over the top of the primary float. With the catch arm in a first catch arm position, the further portion of the catch arm blocks the path of the float guide, preventing the primary float from moving downward and resulting in a full flush. The first catch arm position is obtained by holding a flush actuation arm of the flush tank in a raised position, a secondary link attached to the flush actuation arm and primary float thereby supporting the primary float in a raised position, while the secondary float drops with the water level, whereby the catch arm pivots into the first catch arm position. In a second catch arm position, the further portion of the catch arm does not block the path of the float guide, allowing the primary float to move downward where a contact arm of the primary float prematurely causes an outlet cover to cover a flush outlet of the tank, resulting in a partial flush. The second catch arm position is obtained by only momentarily raising the flush actuation arm, whereby both the primary float and the secondary float drop with the water level together.

3 Claims, 4 Drawing Sheets

DUAL FLUSH FLOAT

FIELD OF THE INVENTION

This invention relates to flush valve systems for use in flush tanks. More particularly, this invention relates to an improvement in dual mode flush valve systems.

BACKGROUND OF THE INVENTION

In recent years, concern has grown over the amount of water that is wasted each year in the home. It has been observed, for example, that it is not always necessary to completely drain a bathroom flush tank. As a result, a number of devices now exist that reduce the amount of water used in a typical bathroom flush tank.

One such device is a plastic float that surrounds an overflow pipe already installed in the flush tank. A plunger extends downward from the float an adjustable distance. In operation, when the flush outlet cover is raised, thereby allowing water to flow out of the tank, the float drops with the water level until the plunger presses against the flush outlet cover, thereby forcing the cover over the water outlet and preventing further water loss from the tank.

This device succeeds in saving water in a relatively simple manner. No complex installation is required, and manufacturing costs of the device are relatively inexpensive. However, it does not allow the user of the flush tank a choice between a full or partial flush, as is sometimes necessary depending upon the amount and type of waste materials to be flushed. For instance, solid waste requires more water to be effectively flushed into the sewage system than does liquid waste.

A number of dual flush devices exist that provide a choice between a full tank flush, whereby the entire amount of water in the tank is expelled, or a partial tank flush, whereby a partial amount of water in the tank is expelled. Unfortunately, these devices typically require the installation of a new, relatively complex flush tank valve and alterations to the flush actuation arm. As a result, the typical homeowner finds it both expensive and difficult to install such devices into his flush tanks, and, consequently, will often not bother to install them.

Clearly, then, there is a need for a relatively simple device that is easy to install in the typical flush tank, is relatively inexpensive to manufacture, and provides a choice between two different flush amounts. The present invention fulfills these needs and provides further related advantages.

SUMMARY OF THE INVENTION

The present invention is a dual mode flush float that is installed in a flush tank and provides a choice of either a full flush or a partial flush. The device attaches to a vertically disposed float guide, such as a common overflow drainage pipe, and comprises a primary float, a catch arm, a secondary float, a second flexible link, and a contact arm. The second flexible link is attached to the pre-existing flush actuation arm such that when the flush actuation arm is held in the raised position, the second flexible link holds the primary float in a raised position.

In operation, to achieve a partial flush, the user raises the flush actuation arm momentarily and then releases it. As water leaves the tank, both the primary and secondary floats drop with the water level until the contact arm contacts the outlet cover of the flush tank, forcing the outlet cover to close over the outlet opening and preventing the remaining water from leaving the tank. The tank is then filled with water in a normal manner, thereby lifting the device to the top of the tank.

To achieve a full flush, the user raises the flush actuation arm for several seconds, thereby keeping the primary float in a raised position. As water leaves the tank, the secondary float drops with the water level, thereby causing the catch arm to pivot over the top of the primary float until it reaches a position above the float guide. The user then releases the flush actuation arm, whereby the catch arm engages the top of the float guide, preventing the device from dropping with the water level in the tank. Consequently, the contact arm is prevented from prematurely closing the flush outlet by contacting the outlet cover, resulting in a full flush of the tank as in normal operation.

This invention is advantageous in that it is a relatively simple device that is easy to install in the typical flush tank, is relatively inexpensive to manufacture, and provides a choice between two different flush amounts. Moreover, the various components on the device are easily adjustable so as to conform to a variety of different flush tank designs. Other features and advantages of the present invention will become apparent from the following more detailed description, taken in conjunction with the accompanying drawings, which illustrate, by way of example, the principles of the invention.

DESCRIPTION OF THE DRAWINGS

The accompanying drawings illustrate the invention. In such drawings.

DETAILED DESCRIPTION OF THE PREFERRED EMBODIMENT

Figure 1:
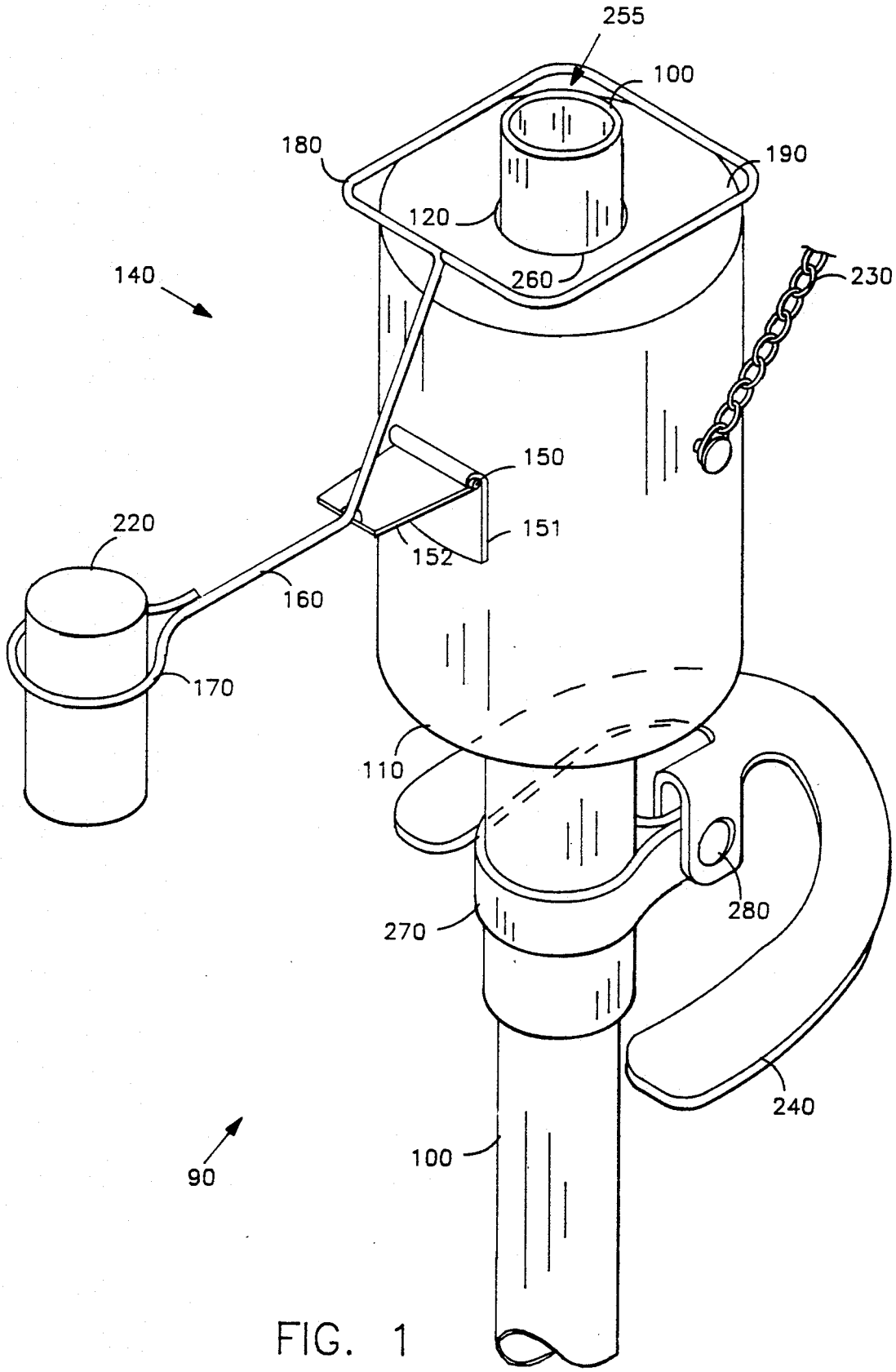
FIG. 1 is a perspective view of the invention in a raised position.

FIG. 1 shows a dual mode flush control apparatus 90. A primary float 110 has a slidable engagement means 120, preferably a passage 260 therethrough, for slidable engagement to a float guide 100, preferably a cylinder 255 oriented in a generally vertical attitude, such as a common flush tank overflow drain. The primary float 110 is constrained by the slidable engagement means 120 to move freely over a vertical path 130 (FIG. 3) established by the float guide 100. In the preferred mode of the invention, the primary float 110 and cylinder 255 are constructed of a durable plastic material.

A catch arm 140 has a pivot arm 152 for pivotal attachment to a pivot base 151 of the primary float 110 with a pivot 150. Preferably, the catch arm 140, pivot 150, pivot base 151, and pivot arm 152 are constructed from stainless steel, or other strong, non-corroding material. One portion 160 of the catch arm 140 extends away from the primary float 110 and terminates in an attachment means 170. A further portion 180 of the catch arm 140 extends over the top 190 of the primary float 110. The pivot 150 permits a first catch arm position 200 whereby a float guide catch 181 of the further portion 180 blocks the vertical path 130 of the float guide 100, thereby preventing the primary float 110 from moving downward along the float guide 100. The pivot 150 also permits a second catch arm position 210 whereby the the float guide catch 181 of the further portion 180 does not block the vertical path 130 of the float guide 100, thereby permitting the primary float 110 to move vertically downward along the float guide 100.

Figure 2:
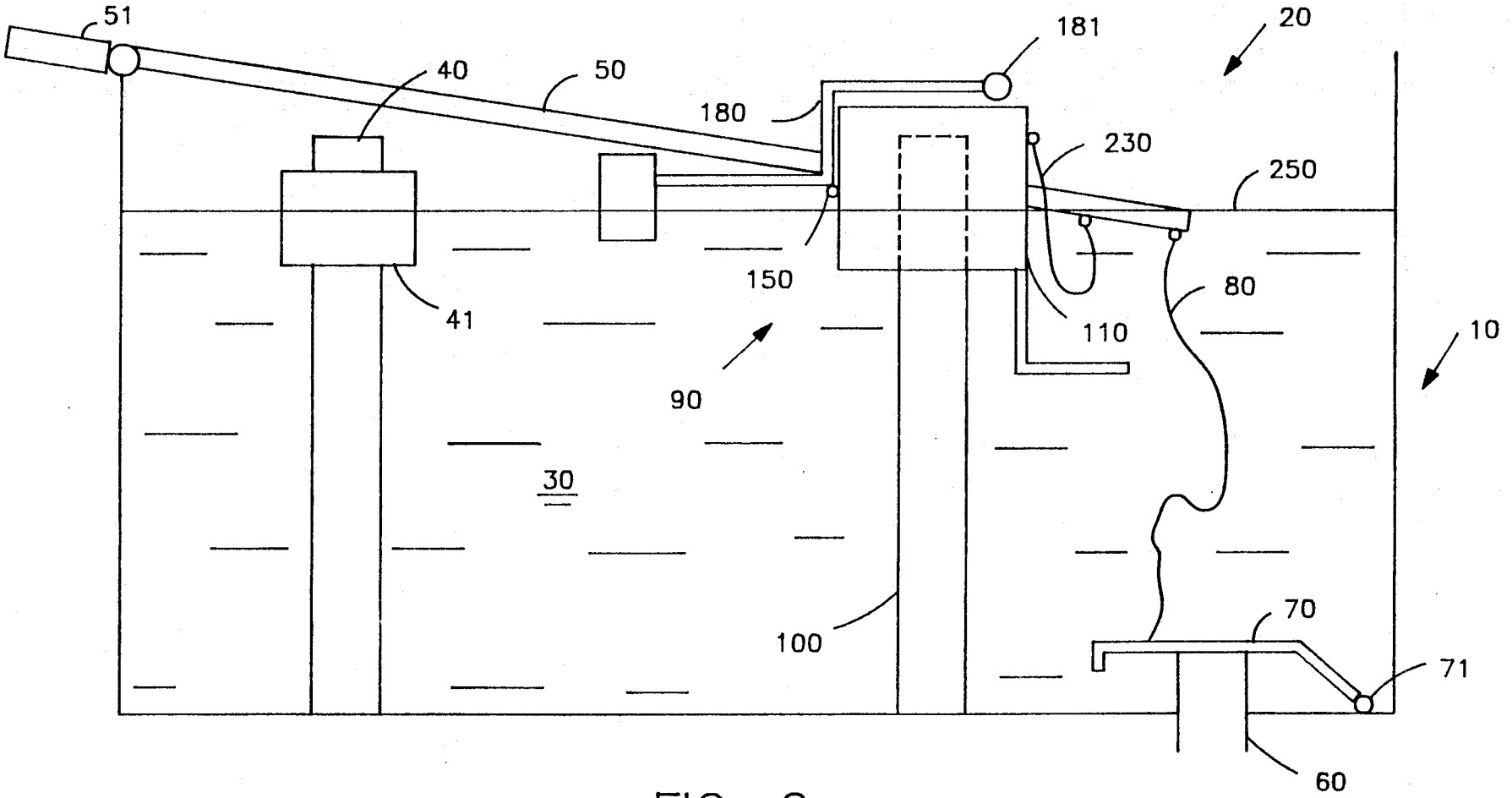
FIG. 2 is a schematic front elevation view of the invention in a flush tank that is full of water.
Figure 3:
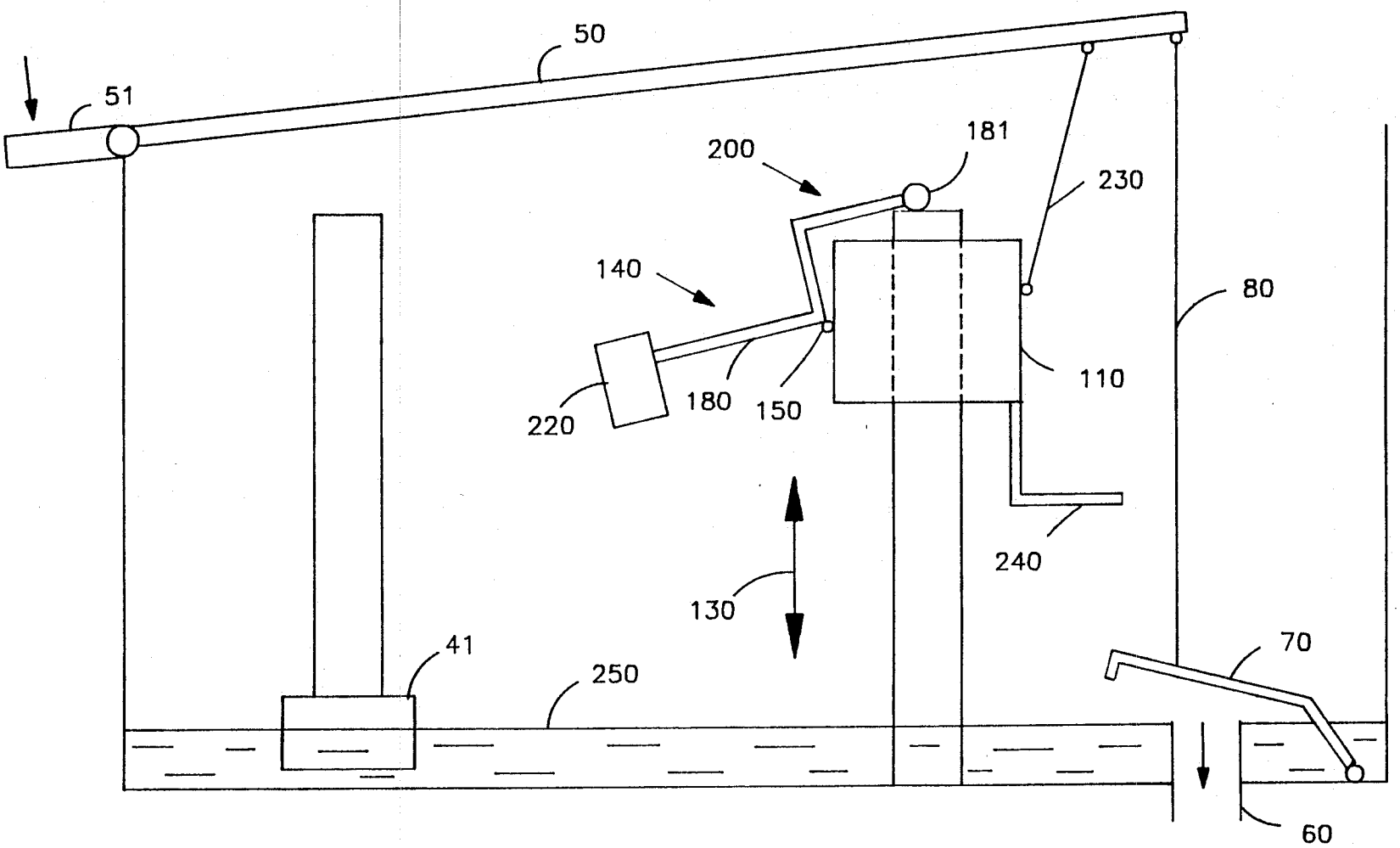
FIG. 3 is a schematic front elevation view of the invention in the flush tank, illustrating a full flush of the tank and the device of the invention in a raised position.
Figure 4:
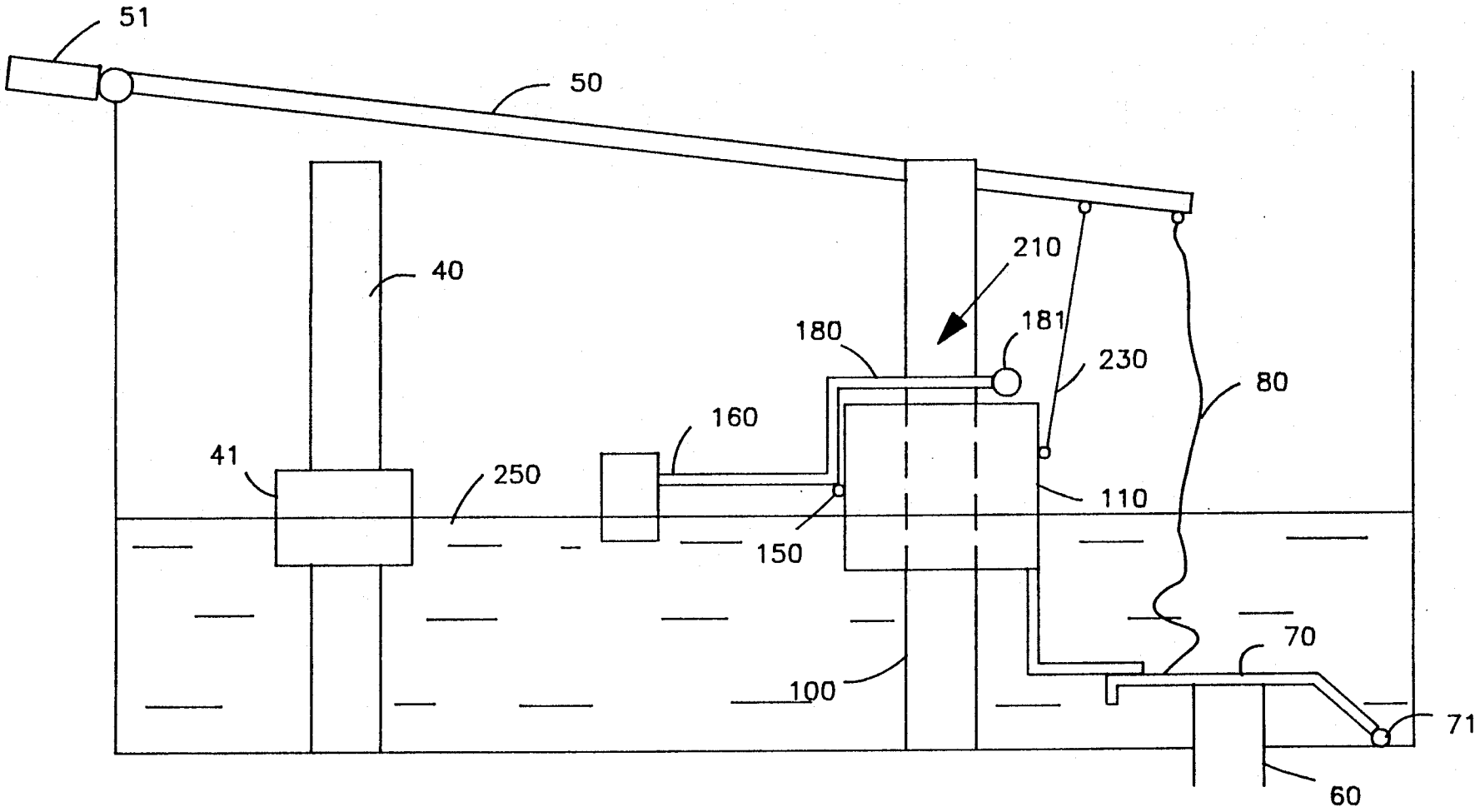
FIG. 4 is a schematic front elevation view of the invention in the flush tank, illustrating a partial flush of the tank and the device of the invention in a lowered position.

A flush tank 10 has a chamber 20 for water 30, a float controlled inlet valve 40, a flush actuation arm 50, a flush outlet 60, and an outlet cover 70. The outlet cover 70 is pivotally attached with a cover pivot 71 to the chamber 20, and is attached to the actuation arm 50 with a first flexible link 80 (FIGS. 2–4). A second flexible link 230 is fixed at one end to the primary float 110 and at the other end to the actuation arm 50, and, like the first flexible link 80, may be constructed from lightweight stainless steel chain or flexible cord. A secondary float 220 is secured by the attachment means 170 to the one portion 160 of the catch arm 140. A contact arm 240 is attached to the primary float 110 and extends therefrom for pressing against the outlet cover 70 to force the outlet cover 70 into a position for closing the flush outlet 60 and thereby preventing water 30 from leaving the chamber 20. Preferably, the contact arm 240 is manufactured from stainless steel, or the like, and has a vertical adjustment means 270 and an angular adjustment means 280 to enable positioning the contact arm 240 for engagement with a variety of outlet covers 70 (FIG. 1).

In operation, to achieve a full flush of the flush tank 10 filled with water 30 (FIG. 3), the flush actuation arm 50 is raised by depressing a flush handle 51 for a length of time T, thereby causing the first flexible link 80 to pull the outlet cover 70 into a raised position, uncovering the flush outlet 60, and allowing the water 30 to flow out of the chamber 20. The second flexible link 230 supports the primary float 110 in a raised position while the secondary float 220 pivots around the pivot 150 so as to drop with a decreasing water level 250, thereby causing the catch arm 140 to assume the first catch arm position 200 at the end of time T. At the end of time T, the flush actuation arm 50 is lowered, the float guide catch 181 of the further portion 180 preventing the primary float 110 from falling, whereby a full flush of the flush tank 10 is achieved and the outlet cover 70 drops to cover the flush outlet 60.

To achieve a partial flush, the flush actuation arm 50 is momentarily raised and then lowered, the catch arm 140 thereby maintaining the second catch arm position 210 as both the primary float 110 and the secondary float 220 drop together with the water level 250 as water 30 leaves the chamber 20 through the flush outlet 60 (FIG. 4). The contact arm 240, extending below and away from the primary float 110, contacts the outlet cover 70 before a full chamber 20 of water 30 has been drained from the flush tank 10. As a result, the outlet cover 70 is forced to cover the flush outlet 60 prematurely and a partial flush is achieved.

The float controlled inlet valve 40 fills the chamber 20 with water 30 when an inlet float 41 is not in a raised position. Consequently, the dual mode flush control apparatus 90, upon completion of either a full flush or a partial flush and with the outlet cover 70 covering the flush outlet 60, will rise with the increasing water level 250. When the inlet float 41, primary float 110, and secondary float 220 reach a raised position, the catch arm 140 thereby achieving the second catch arm position 210, the float controlled inlet valve 40 shuts off, and the flush tank 10 is ready for another flush.

While the invention has been described with reference to a preferred embodiment, it is to be clearly understood by those skilled in the art that the invention is not limited thereto. Rather, the scope of the invention is to be interpreted only in conjunction with the appended claims.

What is claimed is:

1. In a flush tank which has a chamber for water, a float controlled inlet valve, a flush actuation arm, a flush outlet and an outlet cover, the outlet cover being attached to the actuation arm with a first flexible link, the improvement of a dual mode flush control apparatus comprising:

a fixed vertically disposed float guide adjacent to said flush outlet;

a primary float including a means for slidable engagement to said float guide enabling said primary float to move freely over a vertical path established by said float guide;

a catch arm having a pivot for pivotal attachment of said catch arm to said primary float, one portion of said catch arm extending away from said primary float and terminating in an attachment means, a further portion of said catch arm extending over the top of said primary float, said pivot permitting a first catch arm position whereby said further portion of said catch arm blocks said path of said float guide preventing said primary float from moving downward along said float guide, and said pivot permitting a second catch arm position whereby said further portion of said catch arm does not block the path of said float guide, thereby permitting said primary float to move vertically downward along said float guide;

a secondary float secured by said attachment means;

a second flexible link fixed at one end to said primary float and at the other end to said flush actuation arm; and a contact arm attached to said primary float and extending therefrom for pressing against said outlet cover to force said cover into a position for closing said flush outlet, whereby a full flush is achieved by raising said flush actuation arm causing said first flexible link to pull said outlet cover into a raised position uncovering said flush outlet, thereby allowing said water to flow out of said chamber, and holding said flush actuation arm in said raised position until said secondary float drops with the water level, thereby causing said further portion of said catch arm to assume said first catch arm position thereby preventing said primary float from falling, and a partial flush is achieved by raising said flush actuation arm but not holding said flush actuation arm in said raised position until said secondary float drops with the water level, thereby allowing both said primary and said secondary floats to fall together with said water level so that said contact arm can press said outlet cover over said flush outlet prematurely.

2. The apparatus of claim 1 wherein said vertically disposed float guide is a cylinder and said primary float has a passage therethrough for engagement onto said cylinder.

3. The apparatus of claim 2 wherein said contact arm has a means for vertical adjustment and means for angular adjustment to enable positioning said contact arm for engagement with said outlet cover.

* * * * *